US005137111A

United States Patent [19]

Diduck et al.

[11] Patent Number: 5,137,111

[45] Date of Patent: Aug. 11, 1992

[54] ACOUSTIC ABSORBER, AND METHOD OF MANUFACTURE THEREOF

[76] Inventors: Murray F. Diduck; Daniel A. Diduck, both of #121, 52442 Range Rd. 220, Ardrossan, Alberta, Canada, T0B 0E0; Jeffrey M. Dehid, Two Hills, Alberta, Canada

[21] Appl. No.: 557,791

[22] Filed: Jul. 26, 1990

[51] Int. Cl.[5] ..... E04B 1/82

[52] U.S. Cl. ..... 181/295; 181/286

[58] Field of Search ..... 181/295, 286, 288, 285, 181/287

[56] References Cited

U.S. PATENT DOCUMENTS

| | | | |
|---|---|---|---|
| 2,160,638 | 8/1937 | Bedell et al. | 181/295 X |
| 2,502,020 | 3/1950 | Olson | 181/295 |
| 4,319,661 | 3/1982 | Proudfoot | 181/295 |
| 4,548,292 | 10/1985 | Noxon | 181/295 |

FOREIGN PATENT DOCUMENTS 1229801 12/1987 Canada .

*Primary Examiner*—Russell E. Adams
*Assistant Examiner*—Jae Noh
*Attorney, Agent, or Firm*—Anthony R. Lambert

[57] ABSTRACT

A sound absorber has a column shape defined by a hollow, substantially cylindrical wire frame with a filler of uniformly distributed fused parallel filaments having high surface area to mass ratio, such as bloomed cellulose acetate. The sound absorber gives efficient absorption in the articulation frequency range.

A method of manufacture of the sound absorber includes determining the sound response of an acoustic environment, determining the reciprocal of the sound response of that environment, and matching the absorption characteristics of the sound absorber to the reciprocal of the sound response.

Each sound absorber has a linear absorption spectrum above the center frequency so that clusters of the sound absorbers exhibit a similar spectrum.

19 Claims, 5 Drawing Sheets

M/C 12 NEW JET 190/56

ACOUSTIC ABSORBER, AND METHOD OF MANUFACTURE THEREOF

FIELD OF THE INVENTION

This invention relates to acoustic absorption devices, particularly those suitable for absorbing acoustic resonances in an enclosed structure, and a method of manufacturing acoustic absorption devices.

BACKGROUND OF THE INVENTION

In acoustic engineering, it is desirable to eliminate low frequency resonances in a room. Low frequency resonance tends to interfere with later produced sound and causes a deterioration in the quality of the sound perceived by the listener. This has undesirable effects on listening pleasure.

Thus it is known to be desirable to dampen low frequencies with acoustic dampening devices. Previous acoustical dampening devices known to the inventors have typically used fiberglass, rock wool or gypsum as a sound absorber, as disclosed for example in U.S. Pat. No. 4,548,292 issued to Noxon and U.S. Pat. No. 2,160,638 issued to Bedell et al.

However, these and other prior art devices suffer one of the following disadvantages. (1) Inadequate low frequency sound controls in devices incorporating only an absorptive shell. (2) Inappropriate sound absorption to that desired in an enclosed environment. Past devices have proven to be effective only in a finite bandwidth. (3) Inadequate absorption to mass ratio in applications requiring suspension of absorbers. (4) Inadequate absorption to volume ratio where space limitations exist. (5) The necessity of using barriers to prevent high frequency absorption at a specific cut-off frequency. This is less desirable compared with having a gradual reduction in the absorption of high frequencies over the entire range which produces effective equalization of a room's frequency response. (6) A low frequency absorption floor which cannot be extended by use of cluster systems due to their non-linear absorption function. (7) Those made of fiberglass are a known potential health hazard. (8) Those made of fine particulate can cause allergic reactions.

Other systems for solving the sound absorption problem have included the excessive use of absorption material around room boundaries. This conventional solution creates the adverse acoustical side effect of a dead or lifeless sounding space.

SUMMARY OF THE INVENTION

The inventors have developed a new low frequency sound absorber, whose properties in one embodiment represent the acoustic inverse of an acoustical phenomenon that is common to all enclosed spaces.

This basic acoustic phenomenon is as follows. Low frequency sounds (20Hz–1000Hz) take more time to decay away in level than high frequency sounds (greater than 1000Hz) in typical enclosed environments. High frequency sounds are absorbed by such things, common to many interior environments, as air, carpets, curtains, furniture and people, resulting in a specific sound character for each acoustic environment. This character is defined by the reverberation time, being the time required for sound energy to decay 60 decibels (RT-60).

Excessive low frequency reverberation or decay time is undesirable to the listener because of masking effects, the generation of incorrect tonal balance (timbre) and poor base dynamics (mushy or muddy sound), and it is desirable that reverberation time in most enclosed environments be uniform in relation to frequency. Yet excessive low frequency reverberation times and decay rates exist in most enclosed environments regardless of the shape, size or construction of the enclosed environment, with a general relation of increasing reverberation time with decreasing frequency.

For any enclosed environment, the enclosed environment will be defined by barriers, and the heavier the barrier, the higher the transmission loss. Also, the higher the frequency, the higher the transmission loss. However, the transmission losses are also affected by resonance and coincidence effects. Resonance effects occur when the frequency of the incident sound is at a resonance frequency of the barrier, and may result in an increase or decrease in the transmission loss. Coincidence effects occur when the wavelength of the incident sound coincides with the wavelength of a bending wave in the barrier, resulting in lower transmission losses.

The cumulative effects of these factors from structures and barriers in an enclosed environment tend to be random. The inventors have found that these random effects tend to result in a more or less uniform sound absorption response or spectrum for most enclosed environments, and that an optimum absorber may be designed whose absorption spectrum is inverse to the uniform absorption response of enclosed environments.

Thus, in one aspect, the invention provides a passive sound absorber comprising a hollow, substantially cylindrical and acoustically porous frame; and a filler material for the frame having a multiply pointed cross-section, the filler material being substantially uniformly and distributed within the frame.

In another aspect, the filler may be bloomed acetate cellulose, or bloomed flame attenuated glass or bloomed extruded synthetic filler.

In other embodiments, the passive sound absorber may have a packing density of the filler material of about 4 pounds per cubic foot, and the frame may be made of steel mesh.

In another aspect, the invention provides a method of manufacturing a passive sound absorber for an enclosed environment comprising:

- determining the absorption spectrum of the enclosed environment;
- determining the inverse of the absorption spectrum; and
- matching the absorption spectrum of the passive sound absorber to the inverse spectrum.

In a still further aspect, the invention provides a passive sound absorber for an enclosed environment in which the absorption spectrum of the passive sound absorber matches the inverse of the absorption spectrum of the enclosed environment.

In a still further aspect, the invention provides a passive sound absorber for an enclosed environment, the passive sound absorber comprising:

- a hollow, substantially cylindrical and acoustically porous frame; and
- a filler material for the frame composed of elongated parallel fibers having a high surface area to mass ratio, the filler material being substantially uniformly distributed within the frame.

In a still further aspect, the invention provides a cluster of sound absorbers, each sound absorber comprising:

a hollow, substantially cylindrical and acoustically porous frame; and a filler material for the frame composed of elongated fibers having a multiply pointed cross-section, the filler material being substantially uniformly distributed within the frame.

Other combinations of the various embodiments of the invention may be found in the claims.

FIGS. *7a*, *7b*, *7c*, *7d*, *7e* and *7f* show a series of graphs and a series of corresponding top views of clusters of columnar sound absorbers showing the absorption spectrum of the clusters maintaining its characteristic shape with increasing number of sound absorbers in the cluster.

DESCRIPTION OF THE PREFERRED EMBODIMENTS

Figure 3:
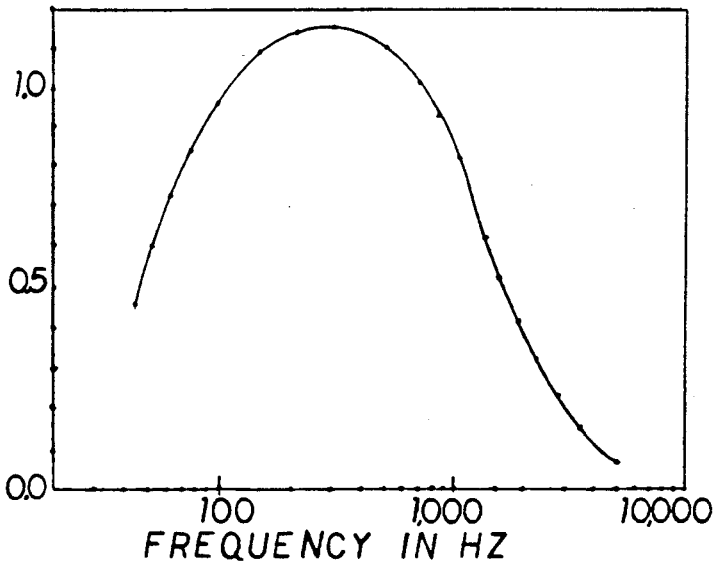
FIG. 3 is a graph showing the frequency response of a passive sound absorber according to the invention.

The inventors have found that the absorption co-efficient of a sound absorber must have increasing absorption with decreasing frequency, with a preferable maximum absorption bandwidth from 100Hz to 1000Hz, with a usable low frequency cut-off of 20Hz. The shape of the acoustic filter response (absorption spectrum) is preferably peaking in nature as shown in FIG. 3 with maximum absorption at 315Hz (center frequency).

The passive sound absorber of the present invention has frequency bandwidth, center frequency and amplitude characteristics designed to suppress reverberations common to most acoustical environments.

Figure 1:
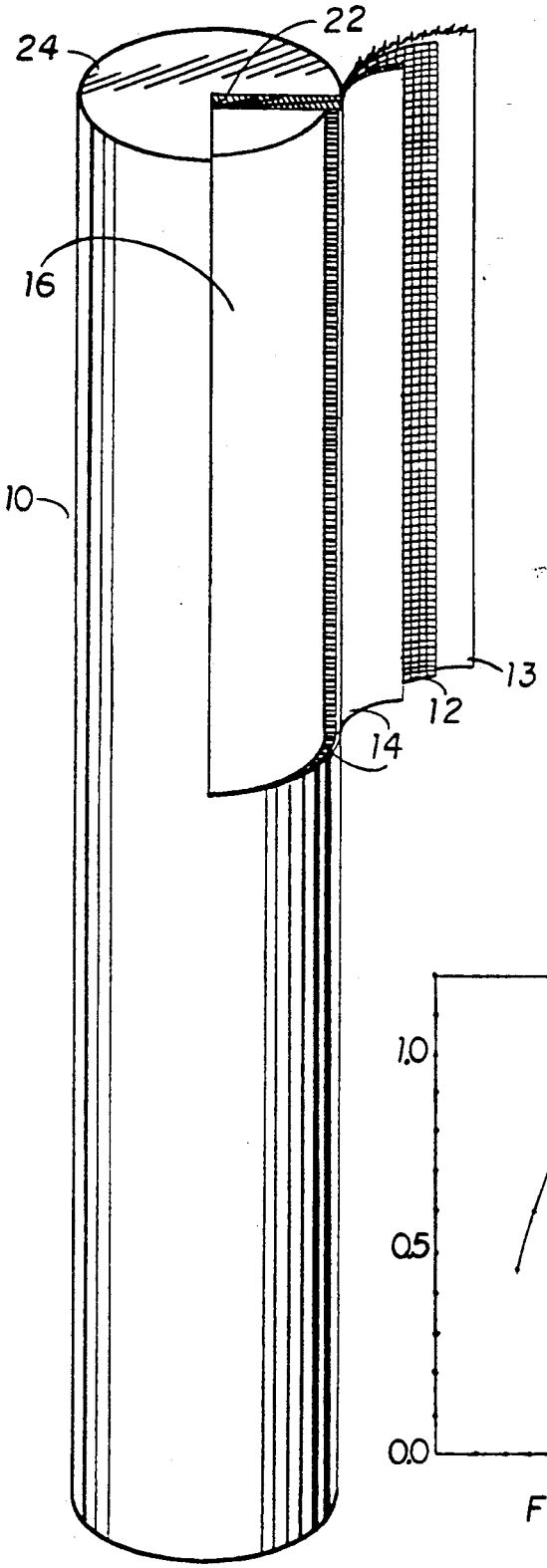
FIG. 1 is a perspective, partly cut away, of a passive sound absorber according to the invention.

Referring to FIG. 1, passive sound absorber 10 has the shape of a column. The column is supported by a wire frame 12 that has the shape of a hollow cylinder. The wire frame 12 is chosen since it provides support with low surface area, and therefore high acoustical porosity. That is, the wire frame 12 provides a skeleton support and is not used for sound absorption. The wire frame is preferably made, for example, of one-half inch welded mesh, 16 gauge steel.

If made of one-inch welded mesh, the wire frame 12 is provided with a Dacron TM liner 14 (as shown) to prevent filler material 16, described below, from protruding in an unaesthetic manner through the wire frame 12. A cover 16, for example made of screening or other similar material, encloses the wire frame 12. The cover 16 is also chosen to be acoustically porous, that is, transparent to sound, and provide an aesthetic function.

The base 22 of the passive sound absorber 10 and the top 24 are made of $\frac{3}{4}$ inch circular plywood, with a diameter of 14 inches, and is finished with a hardboard and Arborite TM facing. The bottom 22 and top 24 are also provided to retain filler material in the passive sound absorber 10, and are designed to have minimum effect on the sound absorption.

The passive sound absorber 10 may be of any desirable height: columns having a height of 2 feet, 3 feet or 6 feet have been found to be adequate, for example for stacking to optimal heights or lengths within tri-hedral corners within an acoustic setting. The spectrum of absorption is independent of the height or length range, and depends more on the diameter of the structure and internal fiber orientation.

Figure 2:
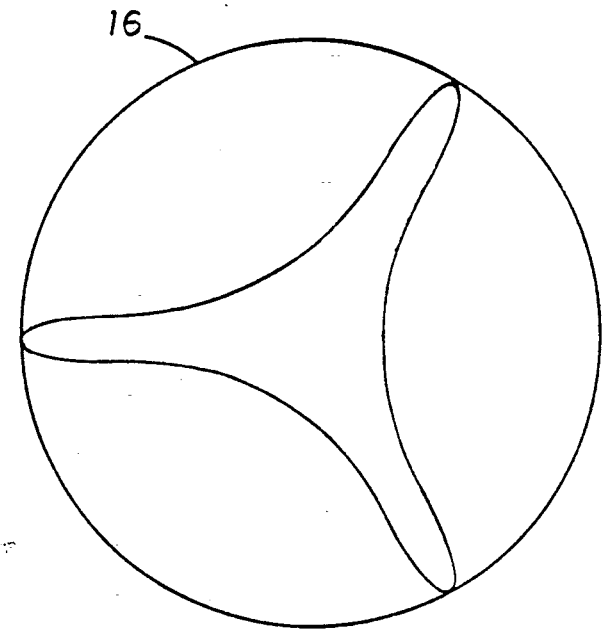
FIG. 2 is a schematic of the fiber filler for a passive sound absorber according to the invention.

Referring also to FIG. 2, the filler material 16 is preferably bloomed cellulose acetate tow, or such other bloomed fibrous material that has particles having the approximate dimensional and density characteristics of cellulose acetate as shown in FIG. 2, and as described below. An example of such another material is flame attenuated fiber-glass or synthetic fiber, such as rayon or nylon, providing the fiber is modified to have the same physical characteristics, since fibers with such characteristics are not presently available. Cellulose acetate tow (or C A tow 4.0Y/41,000) is available from Celanese Canada Inc. of Etobicoke, Ontario, Canada.

The fiber selected should have a high degree of absorption for its mass to volume ratio, particularly when the sound absorber is used in the application of suspended absorption devices within large structures.

A fiber with a large surface area to mass ratio is highly desirable to ensure that low frequency absorption and high frequency roll-off are optimized. Shown in FIG. 2 is a cross-sectional view of a cellulose acetate fiber filament at 4.0 denier/filament. The fiber has a multiply pointed cross-sectional shape, which ensures large surface area to mass ratio. Multiply pointed in this patent means the fiber has a polygonal non-convex cross-sectional shape with at least 6 sides (which may be curved), with at least three pairs of adjacent sides meeting at angles less than 60 degrees. A denier is the weight in grams of 9000 meters of filament of the material. The inventors have found that a minimum surface area to mass ratio of 0.873 $m^2$/denier is desirable to obtain the desired absorption capabilities. A filament having a cross-section like a three-pointed star has been found to give good absorptive qualities. Such a shape also gives strength to the filament by being thickened in the center. If the filament becomes too thin, it may too readily fracture.

The particular form of filler material 16 preferably used in the passive sound absorber 10 is not commercially available, and is manufactured according to the description below. The cellulose acetate has the form, when unprocessed, of a crimped ribbon folded into a 1,221 pound bale. The crimped ribbon contains 10,250 filaments, each filament with a mass of approximately 4.0 denier (weight in grams/9000 m.) The crimped ribbon must be elongated, decompressed, and laid into a bloomed form.

To produce the bloomed cellulose acetate tow, one end of the crimped ribbon is inserted through tension bars onto a reel. The reel is approximately 15 feet wide and 5 feet in diameter. The tension bars place continuous tension on the crimped ribbon as it is wound onto the reel. It is desirable that the tension on the tension bars be maintained as high as possible, just below the breaking point of the crimped ribbon. Once the crimped ribbon has been fed onto the reel, the ribbon is sliced along the bottom of the reel, and four sections removed. The slicing of the crimped ribbon eases the tension, and the ribbon puffs up into a bloom. About 47 passive sound absorbers may be made from one bale. The expansion factor for the pre- and post-processed tow is 1:6.7.

The bloomed cellulose acetate is then drawn into the shape of a column with each filament placed in a vertical formation, and packed into the passive sound absorber 10 with a density of 26 pounds per 6 foot column, that is, a density of 4.1 pounds per cubic foot. It is desirable that the bloomed cellulose acetate be packed in the passive sound absorber 10 with an approximately equal distribution of density.

The packed bloomed cellulose acetate is preferably treated with acetone or a substance having similar characteristics (such as gamma-butyrolactone) to prevent settling or bunching of the fibers. The acetone melts the surface of the fibers and the fibers fuse where they cross each other. This stabilizes the filler material, preventing collapse of the material over time, without affecting the attenuation and absorption characteristics of the sound absorber.

The uniform distribution of the filler material 16 helps to ensure that the sound absorber exhibits a smooth filter response. Discontinuities in the fiber distribution may cause a rippled filter response in the lower bandwidth frequencies, which is undesirable.

Figure 6:
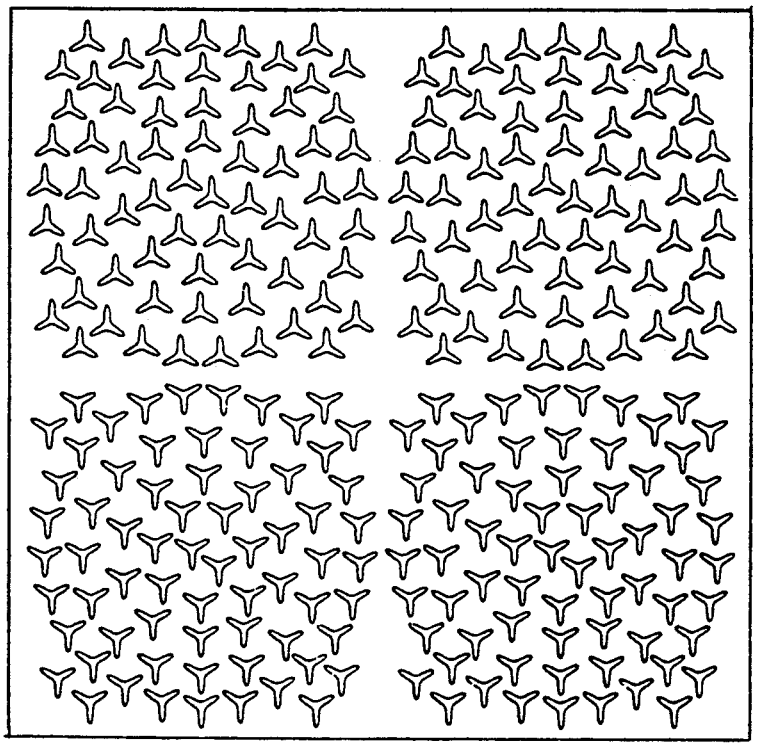
FIG. 6 shows the orientation of filaments in a passive sound absorber.
Figure 7D:
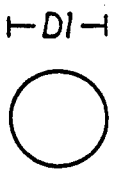
Figure 7A:
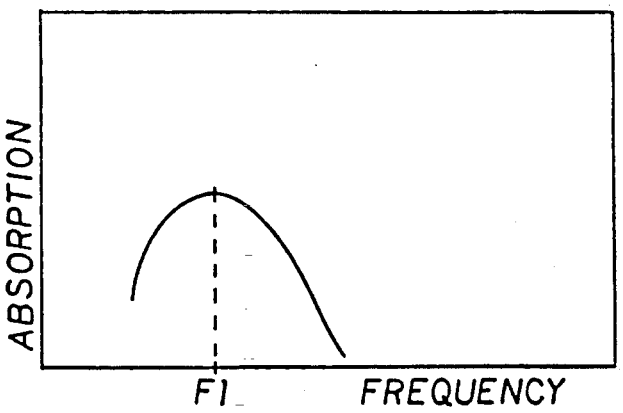
Figure 7E:
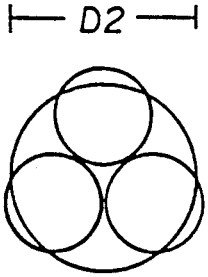
Figure 7B:
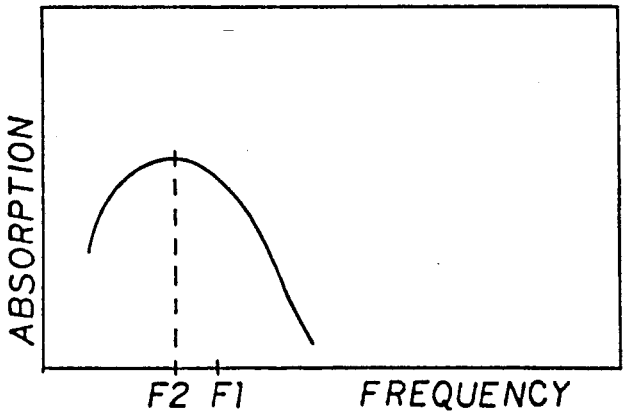
Figure 7F:
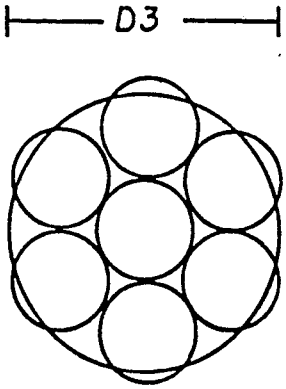
Figure 7C:
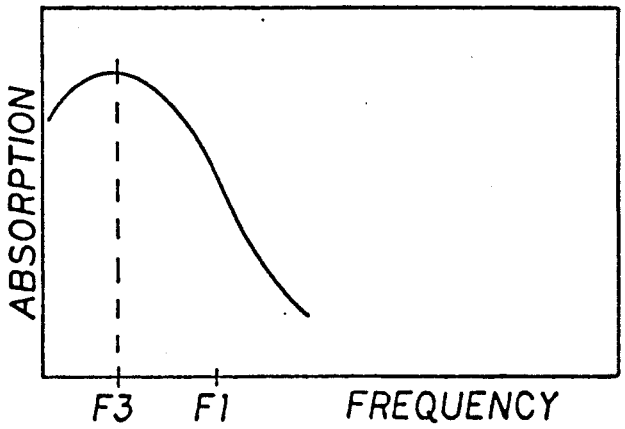

The filler material 16 should also be composed of filaments that are parallel to each other as shown in FIG. 6. The filaments, due to their shape, interlock with each other, thus in part providing the desirable acoustic properties of the sound absorber.

The degree of absorption is set by the blooming process and the surface to mass ratio of the fiber filaments. The amount of absorption per given frequency (slope of the absorption spectrum above the center frequency) is set by the number of fiber filaments within each column.

The resulting passive sound absorber 10 produces a gradient pressure sound absorber with a Q factor of 315 Hz, and suppresses sound in a 1,000 Hz band width about the 315 Hz frequency. The absorption spectrum of the passive sound absorber 10, manufactured in accordance with the above specifications, is shown in FIG. 3. The treatment of the fiber with acetone or gamma-butyrolactone assists in maintaining the uniform linear relationship between the absorption and frequency above the center frequency as shown in FIGS. 3 and 7, without changing the effective absorption of the fiber.

Figure 4A:
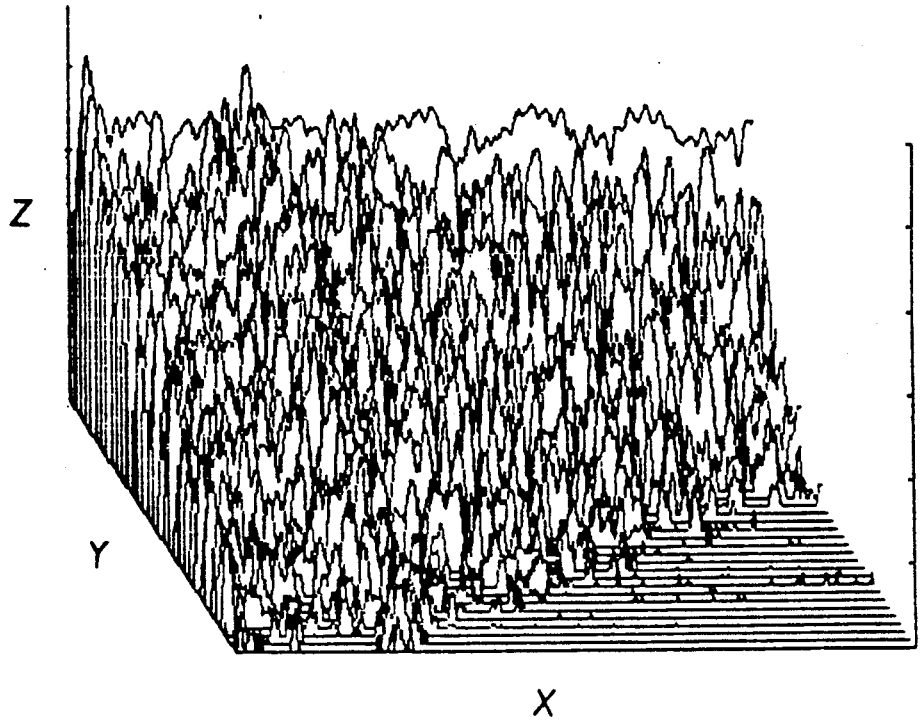
FIG. 4A is a graph showing frequency reverberation in an empty chamber.
Figure 4B:
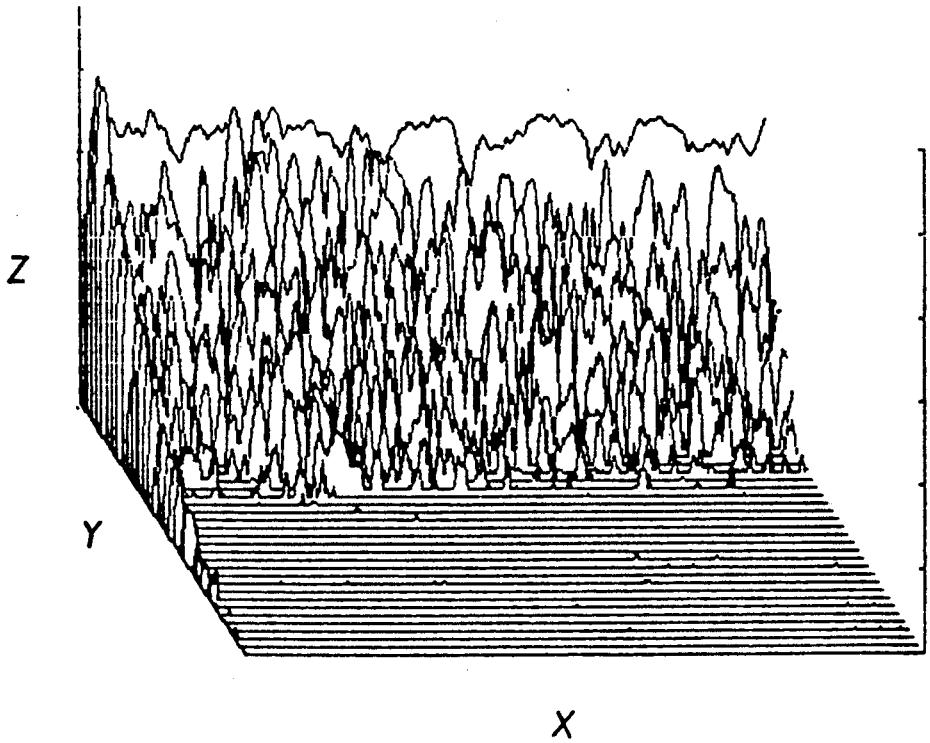
FIG. 4B is a graph showing frequency reverberation in a chamber with eight passive sound absorbers.

The suppression of low frequency reverberations is shown graphically in FIGS. 4A and 4B. Both graphs show how reverberations die out with time. In FIG. 4A, which is for an untreated enclosed environment, the X axis shows frequency (20.35Hz to 4990.46Hz at 535.85Hz/cm) increasing to the right, the Y axis shows time (16.764 millisecs back to 3,500 millisecs front) increasing toward the bottom of the page, and the Z axis shows decibels (10dB/cm with base of display at 96.5dB). It is clear that low frequency vibrations take longer to die out than high frequency vibrations. The axes in FIG. 4B are the same, and show how the installation of passive sound absorbers 10 in the room may efficiently remove the low frequency reverberations. Here, the low frequency reverberations die out at approximately the same rate as the higher frequency reverberations.

Figure 4C:
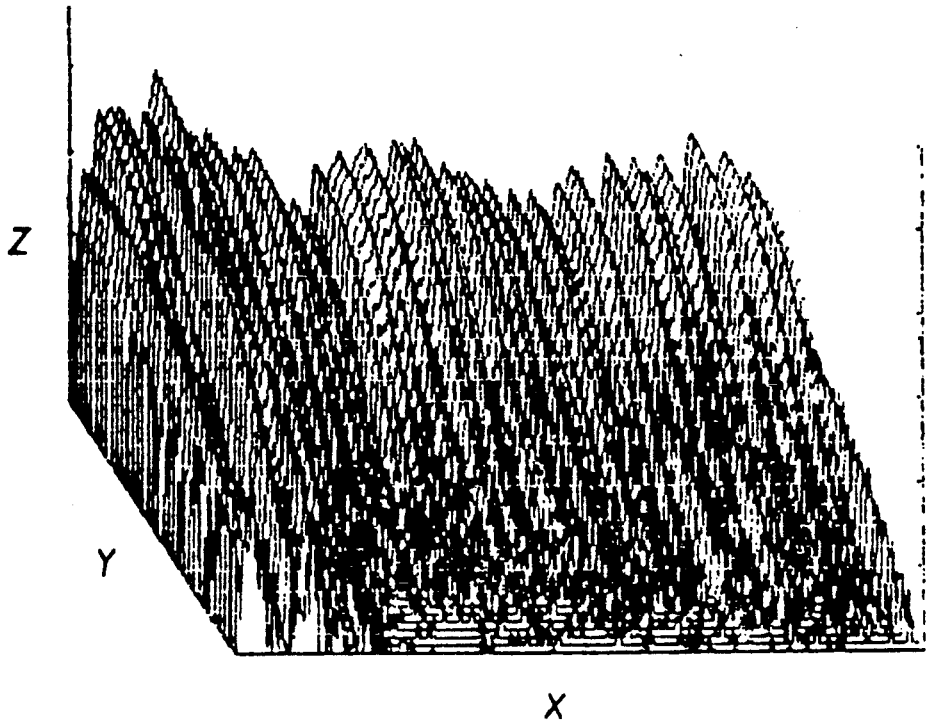
FIG. 4C is a graph showing frequency reverberation in another empty chamber.

FIG. 4C shows an example of the acoustic response of another enclosed environment. The X axis is frequency (11.78Hz to 1400.60Hz), the Y axis is time (205.241 millisecs front to 22.712 millisecs back) and the Z axis is decibels (12dB/cm with base at 93.5dB). The graph shows both the characteristic reverberation spectrum of an enclosed environment, together with the characteristic decay. FIGS. 4A and 4C show the common acoustical characteristics that apply to most enclosed environments. The design of the passive sound absorber is such that the absorption spectrum is the inverse of the reverberation response of most enclosed acoustical environments.

Figure 5:
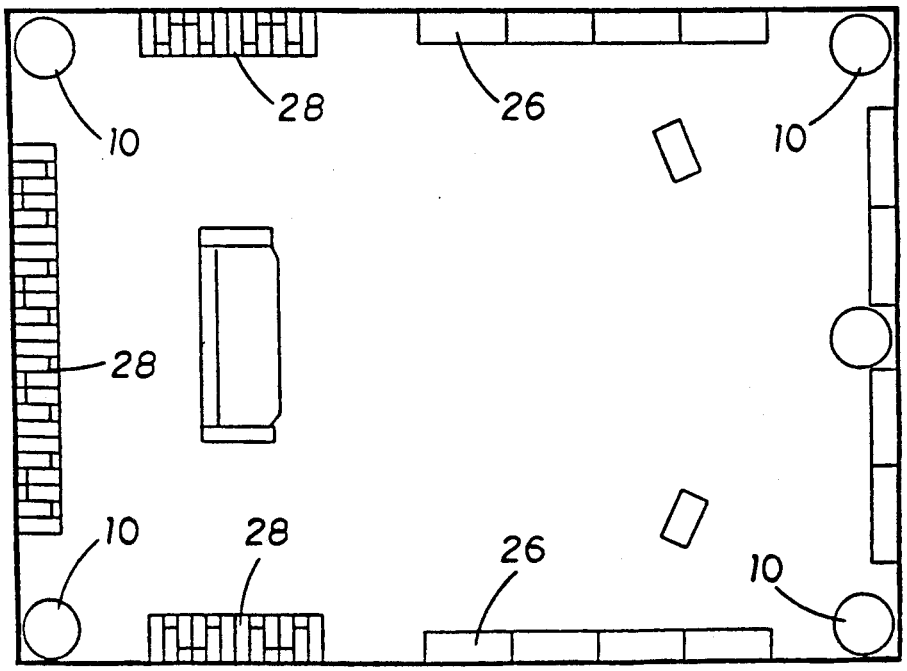
FIG. 5 shows a desirable distribution of passive sound absorbers according to the invention within a room.

A desirable room layout is shown in FIG. 5. Placement of passive sound absorber 10 in the corners of the room are effective in removing low frequency reverberations in the room without unduly filling the room.

In situations where greater lower frequency absorption is required, for example in larger acoustic environments, clustering of the sound absorbers may be used, in which the sound absorbers are arranged in clusters to increase the effective diameter of the sound absorbing system. This results in the center frequency being shifted to a lower frequency. However, because of the linear relationship between the absorption and frequency above the center frequency, which results from the use of the structure described here, the shape of the absorption spectrum remains the same, with the same linear relationship above the center frequency. This effect is seen in FIGS. *7a*, *7b*, *7c*, *7d*, *7e* and *7f* which show (a) the absorption spectrum (with center frequency $f_1$) for one sound absorber with diameter $D_1$, (b) the absorption spectrum (with center frequency $f_2$) for a cluster of three sound absorbers with effective diameter $D_2$, and (c) the absorption spectrum (with center frequency $f_3$) for a cluster of seven sound absorbers with effective diameter $D_3$. The center frequency may be determined approximately according to the equation: $f=v/3d$, where v is the velocity of sound at the temperature of interest, d is the effective diameter of the sound absorber and f is the center frequency.

Further enhancement of the listener's pleasure may be achieved by utilization of mid-band suppressors 26 and quadratic residue diffusers 28. The distribution of the mid-band suppressors 26 and the quadratic residue diffusers 28, as established by known techniques, may considerably enhance the listening environment.

In the method of the invention, the targeted absorption spectrum of the passive sound absorber is determined by taking an average of a variety of sound environments. The method may be applied more specifically, for a particular enclosed environment by: determining the absorption spectrum of the enclosed environment; determining the inverse of the absorption spectrum; and matching the absorption spectrum of the passive sound absorber to the inverse spectrum. The spectrum of the sound absorber described here was determined by taking the inverse of the average of a random sample of enclosed environments, both large and small.

It will be understood by a person skilled in the art that immaterial modifications could be made to the invention, and these are intended to be covered by the scope of the claims that follow.

We claim:

1. A passive sound absorber comprising:

a hollow, substantially cylindrical and acoustically porous frame; and a filler material for the frame composed of elongated fibers having a multiply pointed cross-section, the filler material being substantially uniformly distributed within the frame.

2. The passive sound absorber of claim 1 in which the filler is bloomed cellulose acetate.

3. The passive sound absorber of claim 1 in which the frame is made of steel mesh.

4. The passive sound absorber of claim 1 in which the fibers of the filler are fused together.

5. The passive sound absorber of claim 2 in which the fibers are fused together with acetone or gamma-butyrolactone.

6. The passive sound absorber of claim 1 in which the absorption spectrum of the passive sound absorber matches the inverse of the absorption spectrum of the enclosed environment.

7. A passive sound absorber comprising:

a hollow, substantially cylindrical and acoustically porous frame; and a filler material for the frame composed of elongated parallel fibers having a high surface area to mass ratio, the filler material being substantially uniformly distributed within the frame, the fibers having a multiply pointed cross-section.

8. The passive sound absorber of claim 7 in which the absorption spectrum of the sound absorber is linear above the center frequency.

9. The passive sound absorber of claim 7 in which the filler is bloomed cellulose acetate.

10. The passive sound absorber of claim 7 in which the filler has a surface to mass ratio of at least 0.873 $m^2$/denier.

11. The passive sound absorber of claim 7 in which the frame is made of steel mesh.

12. A passive sound absorber comprising:

a hollow, substantially cylindrical and acoustically porous frame; and a filler material for the frame composed of elongated parallel fibers having a high surface area to mass ratio, the filler material being substantially uniformly distributed within the frame, the fibers being fused together.

13. The passive sound absorber of claim 9 in which the fibers are fused together with acetone or gamma-butyrolactone.

14. A cluster of sound absorbers, each sound absorber comprising:

a hollow, substantially cylindrical and acoustically porous frame; and a filler material for the frame composed of elongated fibers having a multiply pointed cross-section, the filler material being substantially uniformly distributed within the frame.

15. The cluster of sound absorbers of claim 14 in which the absorption spectrum of each sound absorber is linear above the center frequency.

16. The cluster of sound absorbers of claim 14 in which the filler material of each sound absorber is bloomed cellulose acetate.

17. The cluster of sound absorbers of claim 16 in which the filler material of each sound absorber has a surface to mass ratio of at least 0.873 $m^2$/denier.

18. The cluster of sound absorbers of claim 14 in which the frame of each sound absorber is made of steel mesh.

19. The cluster of sound absorbers of claim 14 in which the filler material of each sound absorber is fused.

* * * * *